US006902455B2

(12) United States Patent
Yanagisawa et al.

(10) Patent No.: US 6,902,455 B2
(45) Date of Patent: Jun. 7, 2005

(54) METHOD OF MANUFACTURING MEMBER PATTERN, ELECTRON SOURCE, AND IMAGE DISPLAY DEVICE

(75) Inventors: Yoshihiro Yanagisawa, Kanagawa (JP); Kazuya Ishiwata, Kanagawa (JP); Hiroaki Toshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/241,576

(22) Filed: Sep. 12, 2002

(65) Prior Publication Data

US 2003/0060114 A1 Mar. 27, 2003

(30) Foreign Application Priority Data

Sep. 27, 2001 (JP) ..... 2001-295910

(51) Int. Cl.[7] ..... H01J 9/00
(52) U.S. Cl. ..... 445/24
(58) Field of Search ..... 445/24, 25, 50, 445/51

(56) References Cited

U.S. PATENT DOCUMENTS 6,426,588 B1 7/2002 Yanagisawa ..... 313/422
6,703,791 B2 * 3/2004 Azuma ..... 315/169.3

FOREIGN PATENT DOCUMENTS

JP 8-15716 1/1996

OTHER PUBLICATIONS

U.S. Appl. No. 09/847,420, filed May 3, 2001.
U.S. Appl. No. 09/846,364, filed May 2, 2001.
U.S. Appl. No. 10/207,864, filed Jul. 31, 2002.
U.S. Appl. No. 10/207,842, filed Jul. 31, 2002.
U.S. Appl. No. 10/011,405, filed Dec. 11, 2001.
U.S. Appl. No. 09/845,286, filed May 1, 2001.
U.S. Appl. No. 10/235,757, filed Sep. 6, 2002.

* cited by examiner

*Primary Examiner*—Joseph Williams
(74) *Attorney, Agent, or Firm*—Fitzpatrick, Cella, Harper & Scinto

(57) ABSTRACT

There is provided a method of manufacturing a member pattern having on a substrate, a patterned first belt-shaped member and a plurality of second belt-shaped members that are patterned over from the first belt-shaped member to the substrate, the method including: forming the first belt-shaped member by a printing method; and forming the second belt-shaped members by a process involving exposure and development using a photosensitive material.

13 Claims, 12 Drawing Sheets

METHOD OF MANUFACTURING MEMBER PATTERN, ELECTRON SOURCE, AND IMAGE DISPLAY DEVICE

BACKGROUND OF THE INVENTION

1. Field of the Invention

The present invention relates to a method of manufacturing a member pattern, an electron source, and an image display device using a photosensitive member.

2. Related Background Art

At present, a cathode ray tube (CRT) is generally used as an image display device. A cathode ray tube with a screen size of 30 inches or more has also been placed in the market recently.

However, in order to enlarge a display screen of a cathode ray tube, the cathode ray tube needs to become deeper and heavier according to the screen size. Thus, the cathode ray tube requires a lager space for installation and is not suitable for meeting a demand of consumers desiring to watch powerful images on a larger screen. Therefore, instead of a large and heavy cathode ray tube (CRT), advent of a flat panel display device that consumes less electric power and is thin, light, and large is anticipated so that it can be mounted on a wall.

As a flat panel image display, there are for example a plasma display panel (PDP) that excites a phosphor to emit light by irradiating ultraviolet ray on the phosphor and a flat panel image display device that uses a field emission electron-emitting device (FE) or a surface conduction electron-emitting device as an electron source and irradiates electrons emitted from the electron-emitting device on a phosphor, thereby exciting the phosphor to emit light. As a PDP, one with a large screen of about 40 inches has already appeared on the market.

Incidentally, in order to form an image display device using the above-described electron source, it is necessary to form a large number of electron emitting devices and further form a structural member such as a matrix wiring for supplying driving power to such respective electron-emitting devices.

As a method of manufacturing a matrix wiring of an electron source using a surface conduction electron-emitting device, there is disclosed in JP 8-15716 A an example in which all wirings are formed by a photolithography method.

However, although the photolithography method used in JP 8-15716 A is a method suitable for forming a high precision wiring pattern, it is often expensive because processes for wiring are complicated. Thus, there has been a problem in that costs for manufacturing a display may be increased when the photography method is used for the entire processes for wiring as in JP 8-15716 A.

SUMMARY OF THE INVENTION

The present invention has been devised in view of the above drawbacks of the prior art, and it is an object of the present invention to provide a method of manufacturing a member pattern that is suitable for forming a high precision member pattern such as wiring and can realize cost reduction.

In addition, it is another object of the present invention to provide a method of manufacturing an electron source that can realize cost reduction without damaging electric reliability of matrix wiring for supplying driving power to a plurality of electron-emitting members.

The present invention relates to a method of manufacturing a member pattern that is provided with, on a substrate, a patterned first member and a plurality of second members that are patterned over from the first member to the substrate, which is characterized by including:

forming the first member by a printing method; and forming the second members by a process involving exposure and development with the use of a photosensitive material.

In addition, the present invention relates to a method of manufacturing an electron source that is provided with, on a substrate, a plurality of first wirings, a plurality of second wirings that are crossed over the plurality of first wirings via an insulating member, and a plurality of electron-emitting members that are wired in matrix by the plurality of first and second wirings, which is characterized by including:

forming the plurality of first wirings by a printing method; and forming the plurality of second wirings by a process involving exposure and development with the use of a photosensitive material.

In addition, the present invention relates to a method of manufacturing an image display device provided with an electron source and a member that is arranged so as to oppose the electron source and emits light by irradiation of electrons from the electron source, which is characterized in that the electron source is manufactured by the method described above.

DESCRIPTION OF THE PREFERRED EMBODIMENTS

Figure 1:
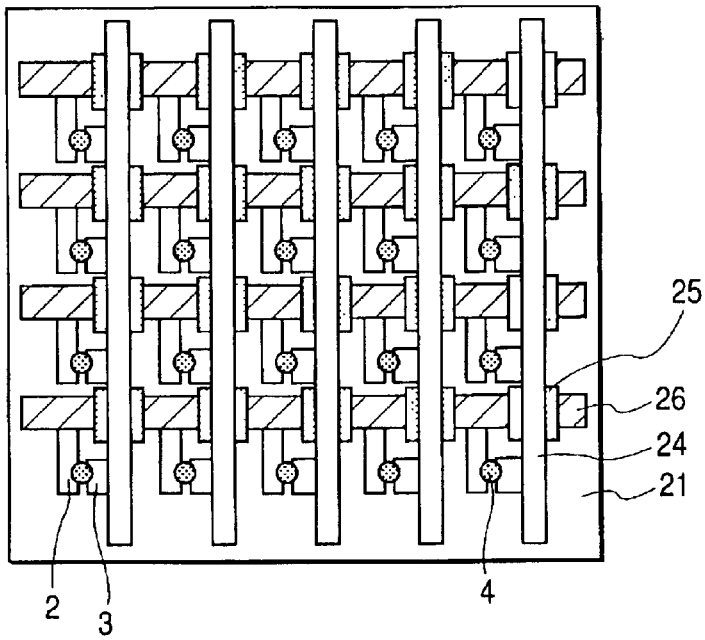
FIG. 1 is a plan view schematically showing an example of a structure of an electron source substrate in accordance with the present invention.

A method of manufacturing a member pattern that is provided with, on a substrate, a patterned first member and a plurality of second members that are patterned over from the first member to the substrate, including:

forming the first member by a printing method; and forming the second members by a process involving exposure and development using a photosensitive material.

Here, the member pattern includes a pattern of a conductor or an insulator that is formed on a substrate as in a circuit substrate, a pattern of a partition wall that is formed on a substrate as in a plasma display panel, a wiring pattern consisting of a conductor as in an electron source, a wiring pattern having a plurality of conductors and insulators that are arranged among the plurality of conductors, or the like.

And, the first and second members may be, for example, belt-shaped members, and are referred as first and second belt-shaped members.

The method of manufacturing a member pattern of the present invention includes the following as preferable forms:

the first and second belt-shaped members are conductive members and an insulating member is arranged between the first belt-shaped member and the second belt-shaped member;

the printing method is a screen printing method;

the printing method has a step of applying a non-photosensitive paste containing a component of the first belt-shaped member on the substrate to form a precursor pattern of the first belt-shaped member and a step of baking the precursor;

the application of the non-photosensitive paste on the substrate is application by screen printing; or the process involving exposure and development using the photosensitive material has a step of applying a photosensitive paste containing a component of the second belt-shaped member on the substrate, a step of exposing and developing the photosensitive paste and forming a precursor pattern of the second belt-shaped member and a step of baking the precursor.

According to the method of manufacturing a member pattern of the present invention, satisfactory adhesion between the second belt-shaped member and the substrate and the first belt-shaped member is realized.

In addition, in the above-mentioned structure in which the first and second belt-shaped members are conductive members and an insulating member is arranged between the first belt-shaped member and the second belt-shaped member, reliability of electric insulation of the first belt-shaped member and the second belt-shaped member is improved.

The process involving exposure and development using a photosensitive material can form a plurality of belt-shaped members with high precision on a substrate 21 in FIGS. 14A to 14E. However, a sectional shape of the belt-shaped member 26 that is formed through such a process assumes a shape such as a rectangular shape shown in FIG. 14A and a reverse tapered shape shown in FIG. 14B in many cases.

On the other hand, an ordinary printing method uses a printing plate and performs patterning of a member without involving exposure and development. A sectional shape of the belt-shaped member 26 formed through such a printing method has a curved surface as shown in FIG. 14C.

Here, the second belt-shape member is patterned over from the first belt-shaped member to the substrate. Thus, if the first belt-shaped member 26 is formed by the printing method and the second belt-shaped member 24 is formed by the process involving exposure and development using a photosensitive material, the sectional shape of the first belt-shaped member 26 has a curved surface as described above. Therefore, adhesion of the second belt-shaped member 24 and the substrate 21 and the first belt-shaped member 26 is improved as shown in FIG. 14D and the plurality of second belt-shaped member 26 with a higher precision pitch can be formed compared with the rectangular shape as shown in FIG. 14A or the reverse tapered shape as shown in FIG. 14B.

Figure 14A:
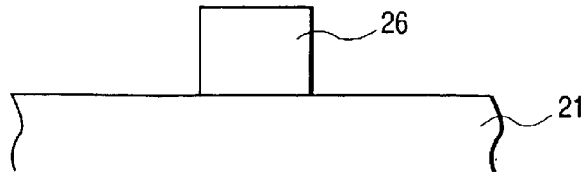
FIGS. 14A, 14B, 14C, 14D and 14E are sectional views for explaining sectional shapes of a belt-shaped member and wiring.
Figure 14B:
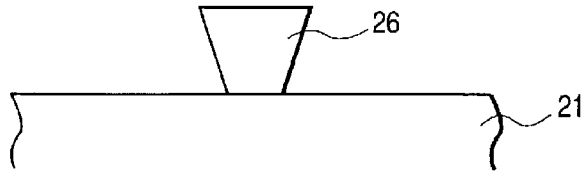
Figure 14C:
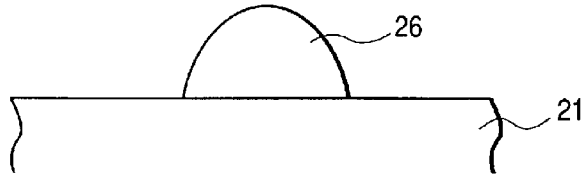
Figure 14D:
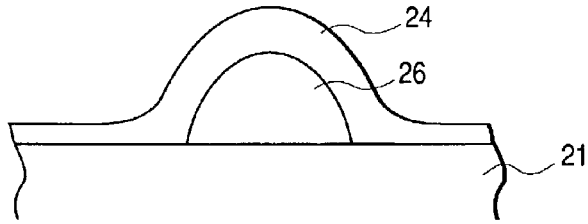
Figure 14E:
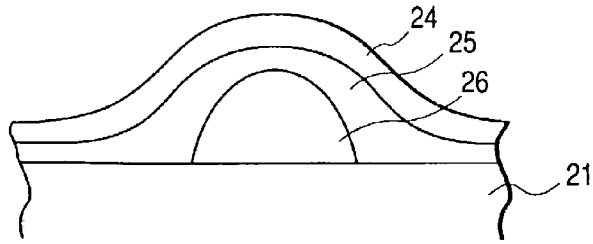

In addition, in the case where the above-mentioned insulating member is formed, if the cross section of the first belt-shaped member 26 has a shape such as the rectangular shape shown in FIG. 14A or the reverse tapered shape shown in FIG. 14B, the insulating member tends to be cut in a side part of the first belt-shaped member. Such cutting of the insulating member tends to occur especially in the case where the insulating member is formed by application of paste containing a component of the insulating member and baking of such paste. Such cutting forms an electric leak path of the first belt-shaped member and the second belt-shaped member. Therefore, again, in this case, if the first belt-shaped member 26 is formed by the printing method and the second belt-shaped member 24 is formed by the process involving exposure and development using a photosensitive material, the sectional shape of the first belt-shaped member 26 has a curved surface as described above. Therefore, reliability of electric insulation of the first belt-shaped member 26 and the second belt-shaped member 24 is improved by the insulating member 25 as shown in FIG. 14E, and at the same time the plurality of second belt-shaped members 24 with a higher precision pitch can be formed compared with the case where the cross section of the first belt-shaped member 26 is the rectangular shape as shown in FIG. 14A or the reverse tapered shape as shown in FIG. 14B.

In addition, the present invention is a method of manufacturing an electron source that is provided with, on a substrate, a plurality of first wirings, a plurality of second wirings that are crossed over the plurality of first wirings via an insulating member and a plurality of electron-emitting members that are wired in a matrix shape by the plurality of first wirings and plurality of second wirings, which is characterized by including:

forming the plurality of first wirings by a printing method; and forming the plurality of second wirings by a process involving exposure and development using a photosensitive material.

The method of manufacturing an electron source of the present invention includes the following as preferable forms:

the printing method is a screen printing method;

the printing method has a step of applying a non-photosensitive paste containing a component of the first wiring on the substrate to form a precursor pattern of the first wiring and a step of baking the precursor;

the application of the non-photosensitive paste on the substrate is application by screen printing;

the process involving exposure and development using the photosensitive material has a step of applying a photosensitive paste containing a component of the second wiring on the substrate, a step of exposing and developing the photosensitive paste and forming a precursor pattern of the second wiring and a step of baking the precursor; or the plurality of first wirings are wirings to which a scan signal is applied and the plurality of second wirings are wirings to which a modulation signal is applied.

In addition, the present invention is a method of manufacturing an image display device provided with an electron source and a member that is arranged so as to oppose the electron source and emits light by irradiation of electrons from the electron source, which is characterized in that the electron source is manufactured by the foregoing method.

According to the method of manufacturing an electron source and an image display device of the present invention, satisfactory adhesion of the second wiring and the substrate is realized, and at the same time the plurality of second wirings with a high precision pitch can be formed according to the same reasons as described above.

In addition, reliability of electric insulation of the first wiring and the second wiring is improved, and at the same time the plurality of second wirings with a high precision pitch can be formed according to the same reasons as described above.

Further, according to the method of manufacturing an electron source and an image display device of the present invention, wiring for a scan signal whose line width can be designed relatively large is formed by a generally inexpensive printing method such as screen printing and wiring for a modulation signal whose line width is required to be designed relatively small is formed by a photoprocess that is generally expensive but can provide high precision, taking into account a correspondence with minimum line width, whereby the expensive photoprocess is controlled to minimum in forming matrix wiring.

A preferred embodiment mode of the present invention will be described illustratively in detail with reference to the accompanying drawings. Note that dimensions, materials, forms and relative arrangements of components described in this embodiment mode are not meant to limit a scope of the present invention only to those dimensions, materials, forms and relative arrangements.

Figure 15A:
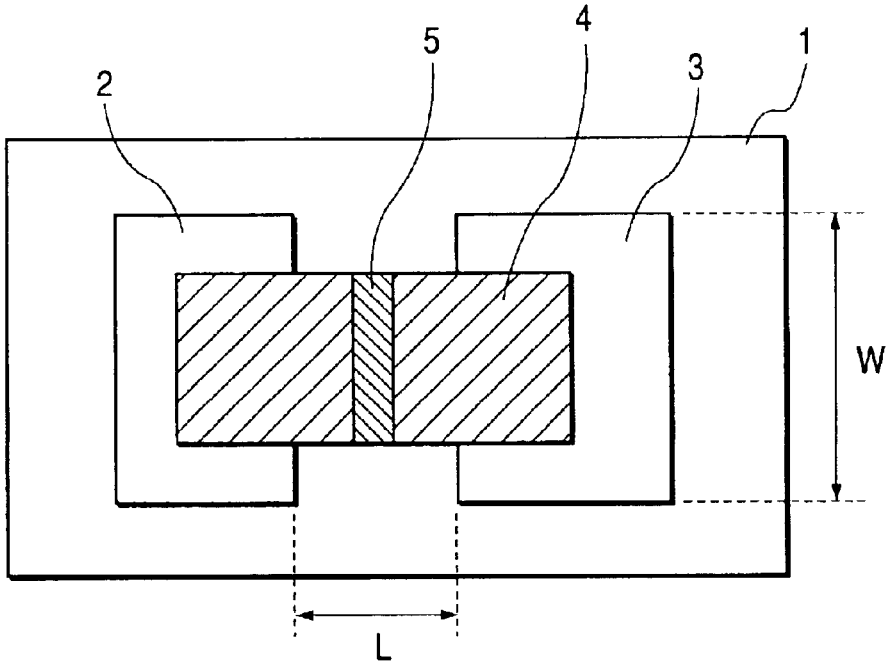
FIGS. 15A and 15B are schematic views showing examples of a structure of a surface conduction electron-emitting device.
Figure 15B:
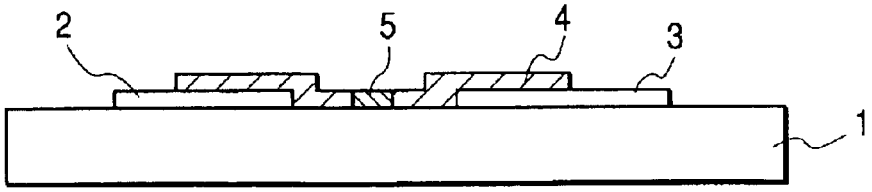

An example of an electron-emitting device that is formed on an electron source substrate of this embodiment mode includes a structure shown in FIGS. 15A and 15B.

A substrate 1 is made of glass or the like. A size and a thickness of the substrate 1 is appropriately set depending on the number of electron-emitting devices to be installed thereon, a designed shape of respective devices and, if it constitutes a part of a container when an electron source is used, dynamic conditions such as an atmospheric pressure proof structure for holding the container in vacuum, and the like.

As a material of the glass, inexpensive soda lime glass is generally used. However, it is necessary to use, for example, a substrate or the like, which is obtained by forming a silicon oxide film with a thickness of 0.5 μm by a sputtering method, as a sodium block layer over it. In addition, the glass can be formed of glass with less sodium or a quartz substrate.

In addition, as a material for device electrodes 2 and 3, a general conductor material is used. For example, metal such as Ni, Cr, Au, Mo, Pt, or Ti or metal such as Pd—Ag is preferable. Alternatively, the material is appropriately selected from a printing conductor formed of metal oxide, glass and the like, a transparent conductor such as ITO, and the like. As its film thickness, preferably, a range of several hundred Å to several μm is appropriate.

An interval L between the device electrodes 2 and 3, a length W and a shape of device electrodes 2 and 3, and the like are appropriately designed according to a form to which actual devices are applied. However, the interval L is preferably several thousand Å to 1 mm and more preferably in a range of 1 μm to 10 μm taking into account a voltage or the like applied between the device electrodes. In addition, the length W is preferably in a range of several μm to several hundred μm taking into account a resistance value and electron-emitting characteristics of the electrodes.

A conductive film (device film) 4 functioning as an electron source is formed to extend over the device electrodes 2 and 3.

As the conductive film 4, a particulate film formed of particulates is especially preferable in order to obtain good electron-emitting characteristics. In addition, a film thickness of the conductive film 4 is appropriately set taking into account a step coverage to the device electrodes 2 and 3, a resistance value between the device electrodes, forming processing discussed later and the like. However, the film thickness is preferably several Å to several thousand Å and more preferably in a range of 10 Å to 500 Å. A sheet resistance value of the conductive film 4 is preferably 103 to 107Ω/□.

Further, the particulate film discussed here is a film which a plurality of particulates are assembled. It indicates a film of not only a state in which particulates are individually arranged to be dispersed but also a state in which particulates are adjacent to or overlap with each other (including an island shape) as its microstructure. A diameter of the particulates is from several Å to several thousand Å and preferably from 10 Å to 200 Å.

In general, palladium Pd is suitable for a conductive film material. However, the conductive film material is not limited to this. In addition, a sputtering method, a method of baking after applying solution, and the like is appropriately used as a film forming method.

An electron-emitting portion 5 is formed by, for example, an energization operation as explained below. Note that, although the electron-emitting portion 5 is shown as a rectangular shape in the center of the conductive film 4 for convenience of illustration, this is simply schematic and does not faithfully represent a position and a shape of an actual electron-emitting portion.

When an electric current is applied between the device electrodes 2 and 3 from a power supply (not shown) under a predetermined vacuum degree, a gap (crack) with a varied structure is formed in a region of the conductive film 4. This gap area constitutes the electron-emitting portion 5. Further, although electron emission also occurs from the vicinity of the gap formed by this forming under a predetermined voltage, an electron emission efficiency is still very low in this state.

Figure 8A:
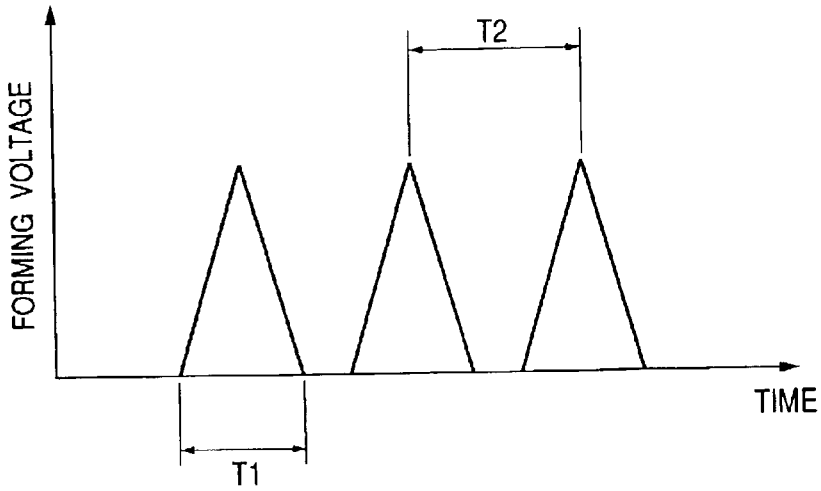
FIGS. 8A and 8B are views showing examples of a forming voltage.
Figure 8B:
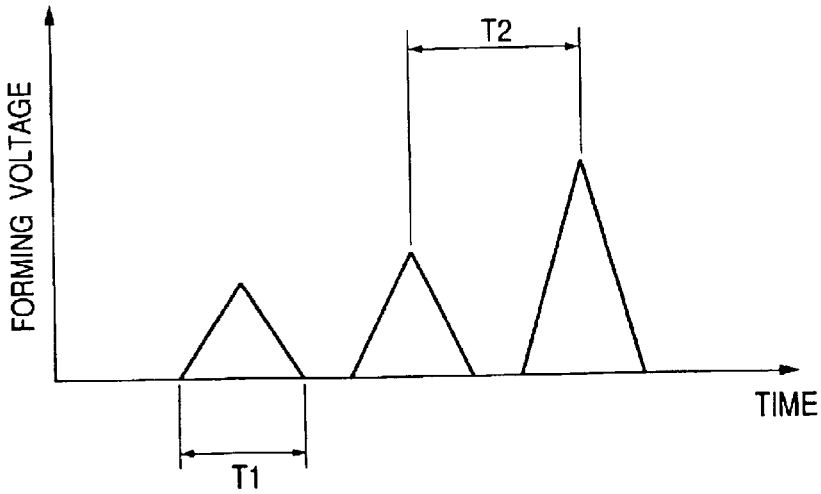

An example of a voltage waveform of energization forming is shown in FIGS. 8A and 8B. In particular, the voltage waveform is preferably a pulse waveform. As the energization forming, there are a method shown in FIG. 8A in which a pulse with a pulse peak value set as a constant voltage is continuously applied and a method shown in FIG. 8B in which a pulse is applied while increasing a pulse peak value.

First, the case in which a pulse peak value is set as a constant voltage will be described with reference to FIG.

8A. Reference symbols T1 and T2 in FIG. 8A denote a pulse width and a pulse interval of a voltage waveform, respectively. Usually, T1 is set in a range of 1 μs to 10 msec and T2 is set in a range of 10 μs to 100 msec. A peak value of a triangular wave (peak voltage at the time of energization forming) is appropriately selected according to a form of an electron-emitting device. Under such conditions, for example, a voltage is applied for several seconds to several tens of minutes. A pulse wave is not limited to a triangular wave, and a desired waveform such as a rectangular wave can be adopted.

Next, the case in which a voltage pulse is applied while increasing a pulse peak value will be described with reference to FIG. 8B. T1 and T2 in FIG. 8B can be set in the same manner as shown in FIG. 8A. A peak value of a triangular wave can be increased, for example, by approximately 0.1 V step.

In the energization forming operation, an electric current flowing through a device to which a pulse voltage is being applied is measured to find a resistance value, and energization forming can be finished when the resistance value indicates, for example, 1 MΩ or more.

An electron emission efficiency is very low in a state after this forming operation. Thus, in order to increase the electron emission efficiency, it is desirable to apply an operation called activation to the device.

This activation operation can be performed by applying a pulse voltage repeatedly between the device electrodes 2 and 3 under an appropriate vacuum degree in which an organic compound exists. Then, a gas containing carbon atoms is introduced, and carbon or a carbon compound derived from the gas is deposited as a carbon film in the vicinity of the gap (crack).

An example of this process will be described. For example, tolunitrile is used as a carbon source and is introduced into a vacuum space through a slow leak valve to maintain a pressure of approximately $1.3\times10^{-4}$ Pa. A pressure of tolunitrile to be introduced is preferably in the order of $1\times10^{-5}$ Pa to $1\times10^{-2}$ Pa, although it is slightly affected by a shape of a vacuum device, a member used in the vacuum device, or the like.

Figure 11A:
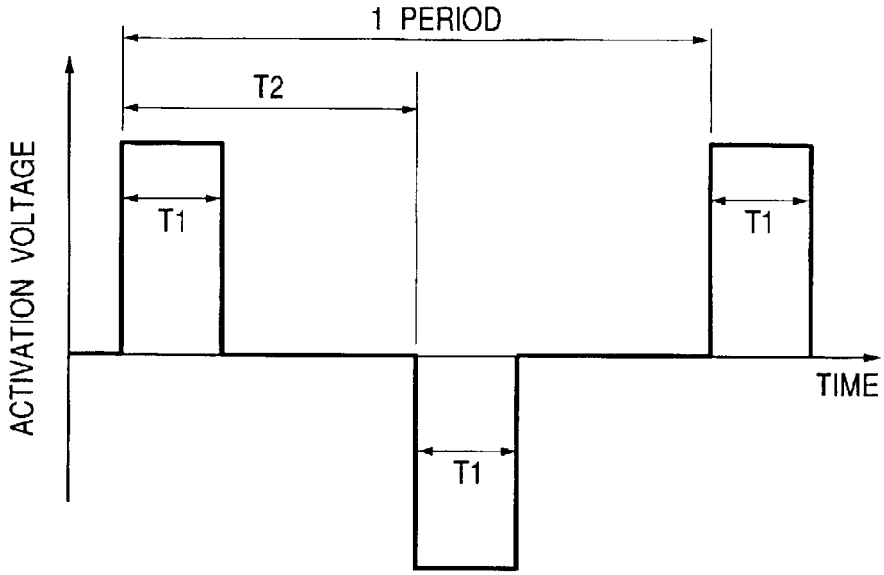
FIGS. 11A and 11B are views showing examples of an activation voltage.
Figure 11B:
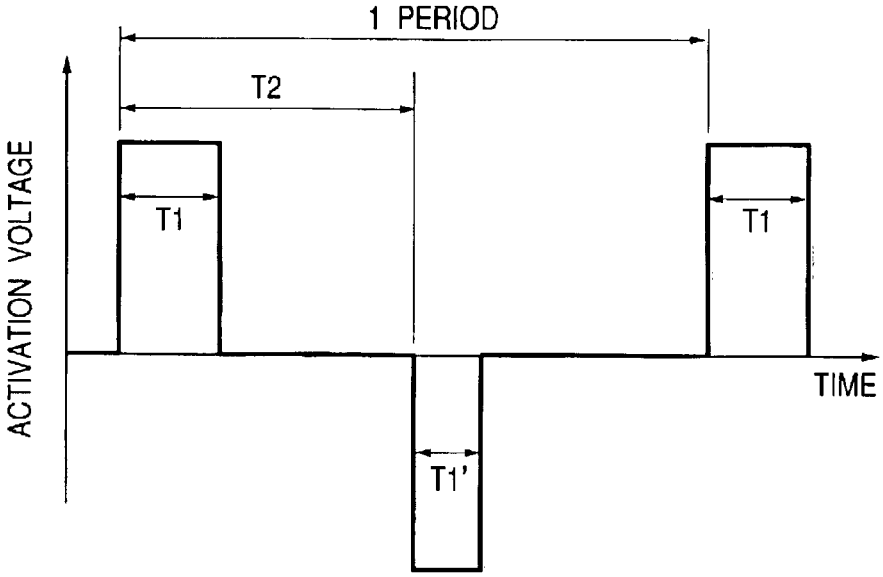

FIGS. 11A and 11B show preferred examples of voltage application used in the activation process. A maximum voltage value to be applied is appropriately selected in a range of 10 V to 20 V.

In FIG. 11A, reference symbol T1 denotes positive and negative pulse widths of a voltage waveform and reference symbol T2 denotes a pulse interval. Positive and negative voltage values are set such that their absolute values are the same. In addition, in FIG. 11B, reference symbols T1 and T1' denote positive and negative pulse widths of a voltage waveform, respectively, and reference symbol T2 denotes a pulse width. T1 is set larger than T1', and positive and negative voltage values are set such that their absolute values are the same.

At this point, energization is stopped when an emission current Ie has nearly reached saturation after approximately sixty minutes, the slow leak valve is closed and the activation operation is finished.

An electron-emitting device as shown in FIGS. 15A and 15B can be manufactured by the above-mentioned process.

Basic characteristics of the electron-emitting device that has the above-mentioned device structure and is manufactured by the above-mentioned method will be described with reference to FIGS. 9 and 10.

Figure 9:
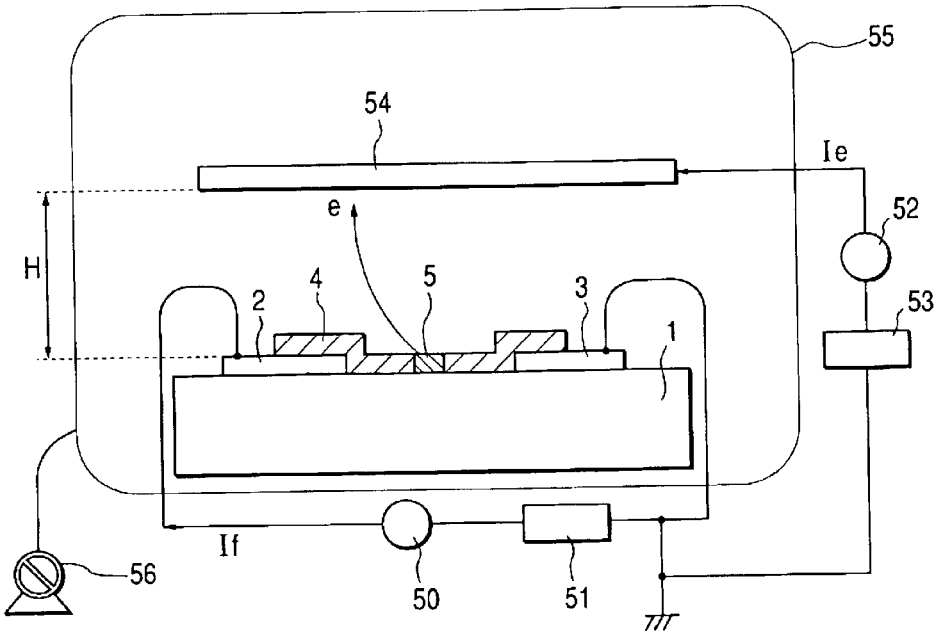
FIG. 9 is a view schematically showing an apparatus for measuring characteristics of an electron-emitting device in accordance with the present invention.

FIG. 9 is a schematic view of a measurement evaluation device for measuring electron emission characteristics of the electron-emitting device having the above-mentioned structure. In FIG. 9, reference numeral 51 denotes a power supply for applying a device voltage Vf to the device; 50, an electric current meter for measuring a device current If flowing through an electrode portion of the device; 54, an anode electrode for capturing an emission current Ie emitted from an electron-emitting portion of the device; 53, a high voltage power supply for applying a voltage to the anode electrode 54; and 52, an electric current meter for measuring the emission current Ie emitted from the electron-emitting portion of the device.

In measuring the device current If flowing between the device electrodes 2 and 3 of the electron-emitting device and the emission current Ie to the anode, the power supply 51 and the electric current meter 50 are connected to the device electrodes 2 and 3 and the anode electrode 54, to which the power supply 53 and the electric current meter 52 are connected, is arranged above the electron-emitting device.

In addition, the electron-emitting device and the anode electrode 54 are installed within a vacuum device 55, and equipment necessary for a vacuum device such as an exhaust pump 56 and a vacuum meter is provided in the vacuum device 55, whereby measurement and evaluation of the device can be performed under a desired vacuum state. Note that measurement was performed with a voltage of the anode electrode 54 in a range of 1 kV to 10 kV and a distance H between the anode electrode and the electron-emitting device in a range of 2 mm to 8 mm.

Figure 10:
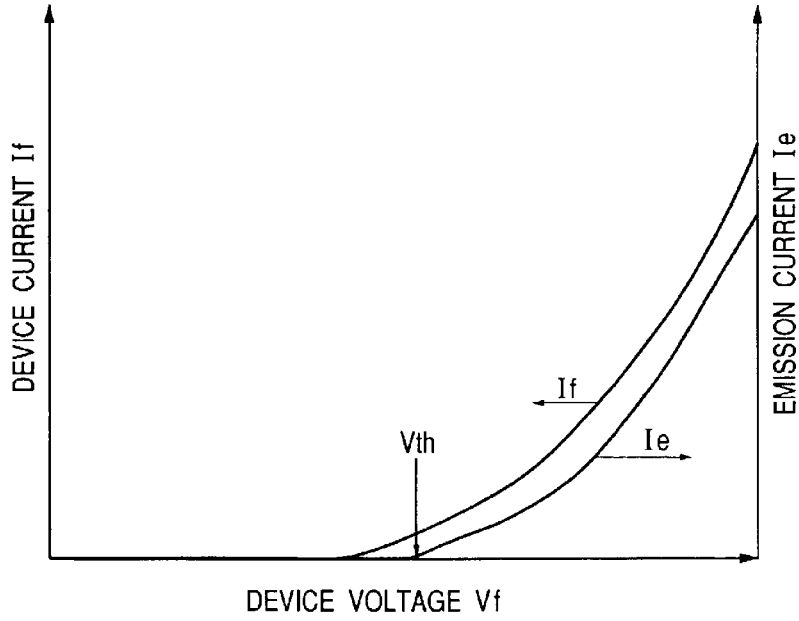
FIG. 10 is a view showing a relationship between a device current and an emission current and a device voltage of a surface conduction electron-emitting device in accordance with the present invention.

A typical example of a relationship between the emission current Ie and the device current If and the device voltage Vf, which are measured by the measurement evaluation device shown in FIG. 9, is shown in FIG. 10. Note that, although the emission current Ie and the device current If are extremely different in magnitude, the vertical axis is represented by an arbitrary unit in a linear scale in FIG. 10 for qualitative comparison and examination of variations of If and Ie.

The electron-emitting device has three characteristics with respect to the emission current Ie.

First, as is also evident from FIG. 10, in the device, the emission current Ie abruptly increases when a device voltage equal to or higher than a certain voltage (which is called a threshold voltage; Vth in FIG. 10) is applied. On the other hand, the emission current Ie is hardly detected when a device voltage is equal to or lower than the threshold voltage Vth. That is, it is seen that the device shows characteristics as a nonlinear device having the clear threshold voltage Vth with respect to the emission current Ie.

Secondly, since the emission current Ie depends on the device voltage Vf, the emission current Ie can be controlled according to the device voltage Vf.

Thirdly, an emission charge captured by the anode electrode 54 depends on a duration of time for applying the device voltage Vf. That is, a charge amount captured by the anode electrode 54 can be controlled according to a duration of time for applying the device voltage Vf.

Next, an electron source substrate and an image display device in accordance with this embodiment mode will be described.

A basic structure of the electron source substrate of this embodiment mode includes a structure shown in FIG. 1 as an example.

In this electron source substrate, a plurality of X-direction wirings (wirings for a scan signal) 26 are formed on a substrate 21 and a plurality of Y-direction wirings (wirings for a modulation signal) 24 are formed on the X-direction wirings 26 via an interlayer insulating layer 25. Electron-emitting devices are arranged in the vicinity of crossing portions of both the direction wirings, respectively.

After the wirings are turned into a panel as an image display device, the X-direction wirings 26 act as a scanning electrode and are required to have a lower wiring resistance than the Y-direction wirings 24 that act as a modulation signal electrode. Thus, the X-direction wirings 26 are designed to be large in a line width or thick in a film thickness. That is, the X-direction wirings (wirings for a scan signal) 26 can be designed to be thick in a line width compared with the Y-direction wirings (wirings for a modulation signal) 24.

This embodiment mode is characterized most in that the wirings for a scan signal (X-direction wirings) 26, which can be designed to be relatively large in a line width, is formed by generally inexpensive screen printing and the wiring for a modulation signal (Y-direction wirings) 24, which is required to be designed to be relatively small in a line width, is formed by a photoprocess that is generally expensive but can be made high precision taking into account a case in which the wirings should cope with a smallest line width. In this way, a method of forming a matrix wiring is selected taking into account its line width and the generally expensive photoprocess is controlled to minimum in forming a matrix wiring, whereby an electron source substrate as well as an image display device that are lower in costs can be realized.

Further, the interlayer insulating layer 25 can be formed by the photoprocess or the screen printing or by combining the photoprocess and the screen printing.

Next, an example of the image display device of this embodiment mode that uses the electron source substrate of the above-mentioned passive matrix arrangement will be described with reference to FIG. 12.

Figure 12:
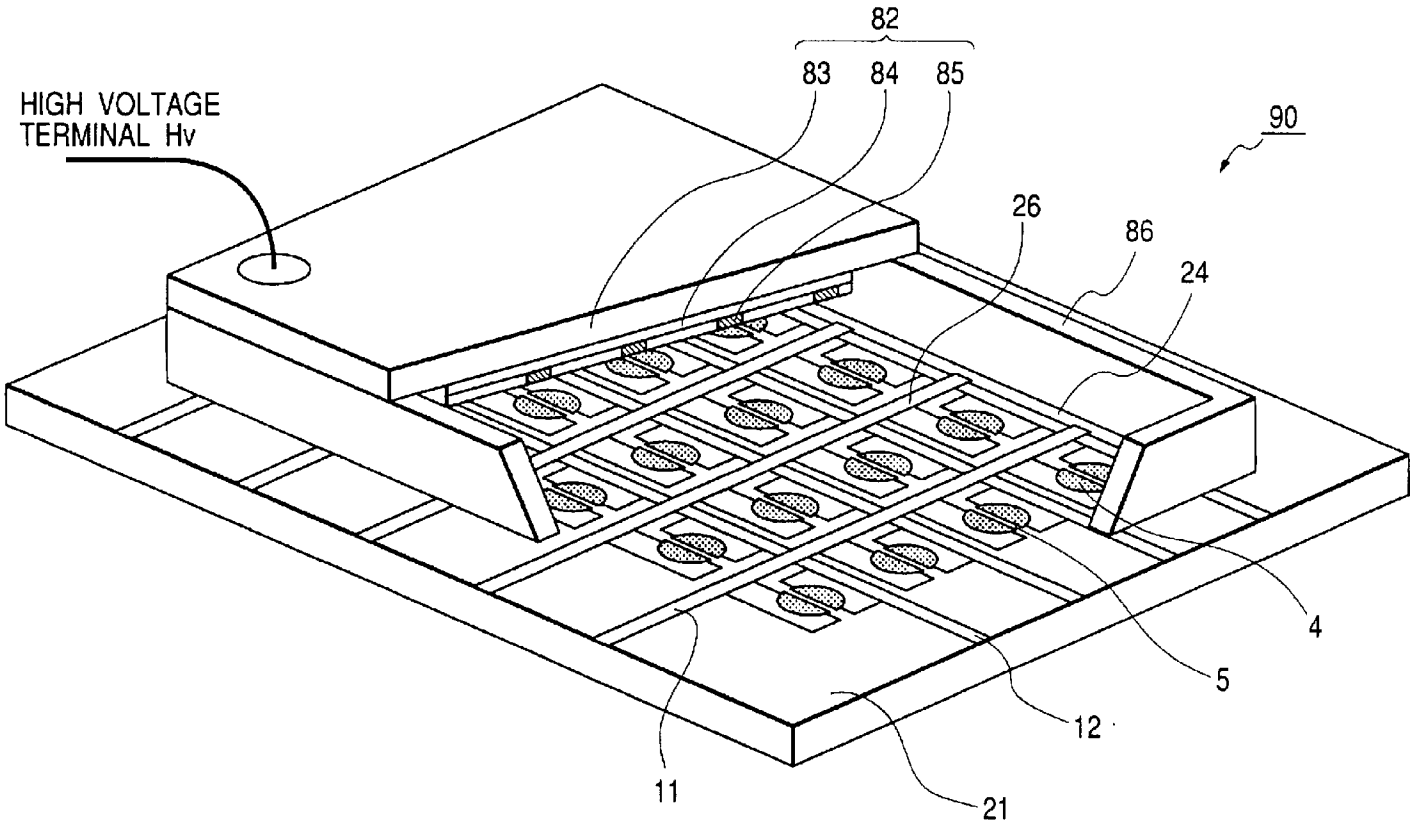
FIG. 12 is a perspective view schematically showing an example of a structure of an image display device in accordance with the present invention.

In FIG. 12, reference numeral 21 denotes the above-mentioned electron source substrate; 82 denotes a face plate in which a fluorescent film 84, a metal back 85 and the like are formed on an inner side of a glass substrate 83; and 86 denotes a supporting frame. The electron source substrate 21, the supporting frame 86 and the face plate 82 are adhered by frit glass and seal bonded by baking at 400° C. to 500° C. for 10 minutes or more to constitute an envelope 90.

Further, a supporting body (not shown) called a spacer is installed between the face plate 82 and the electron source substrate 21, whereby the envelope 90 that has a sufficient strength against the atmospheric pressure also in the case of a large area panel can be constituted.

Figure 13A:
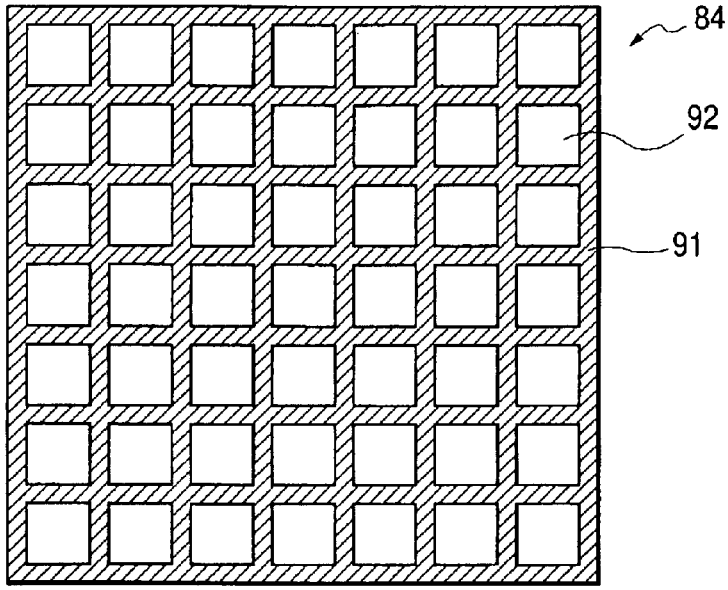
FIGS. 13A and 13B are views schematically showing examples of a fluorescent film in the image display device in accordance with the present invention.
Figure 13B:
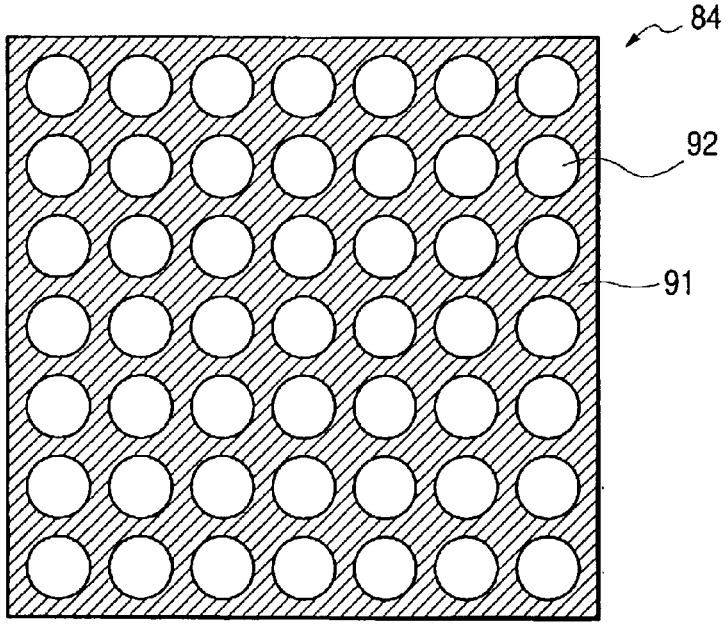

FIGS. 13A and 13B are explanatory views of the fluorescent film 84 provided on the face plate 82. The fluorescent film 84 consists only of phosphors in the case of a monochrome fluorescent film. In the case of a color fluorescent film, it is constituted of black conductors 91, which are called a black stripe or a black matrix depending on an arrangement of phosphors, and phosphors 92. Purposes of providing the black stripe or the black matrix are to make a mixed color or the like less conspicuous by blacking a separate coating portion between each phosphor 92 of three primary color phosphors that are required in the case of color display and to control decrease of a contrast due to reflection of external light in the fluorescent film 84.

In addition, the metal back 85 is usually provided on the inner side of the fluorescent film 84. Purposes of providing the metal back are to improve luminance by specular reflection of light to the inner side among emitted light of phosphors to the face plate 82 side, to cause it to act as an anode electrode for applying an electron beam acceleration voltage, and the like. The metal back can be manufactured by performing a smoothing operation (usually called filming) of the surface on the inner side of the fluorescent film after manufacturing a fluorescent film and thereafter depositing Al thereon by vacuum evaporation or the like.

In performing the above-mentioned seal bonding, since each color phosphor and the electron-emitting device should be associated with each other in the case of the color fluorescent film, it is necessary to perform sufficient positioning of them by a method of abutting upper and lower substrates.

Since a vacuum degree of approximately $10^{-5}$ Pa is required at the time of seal bonding and, in addition, getter processing may be performed in order to maintain a vacuum degree after sealing the envelope 90. This is processing for heating a getter arranged in a predetermined position (not shown) inside the envelope by a heating method such as resistance heating or high frequency heating immediately before performing the sealing of the envelope 90 or after the sealing to form an evaporation film. The getter usually contains Ba and the like as main components and maintains a vacuum degree by an absorbing action of the evaporation film.

According to the aforementioned basic characteristics of the surface conduction electron-emitting device, electrons emitted from the electron-emitting portion are controlled by a peak value and a width of a pulse shape voltage to be applied between opposed electrodes at the threshold voltage or more, and an electric current amount is controlled by its intermediate value as well, whereby half tone display becomes possible.

In addition, in the case where a large number of electron-emitting devices are arranged, if a selected line is determined according to a scanning line signal of each line and the pulse shaped voltage is appropriately applied to the respective devices through each information signal line, it becomes possible to appropriately apply a voltage to an arbitrary device and each device can be turned ON.

Further, a system for modulating an electron-emitting device according an input signal having half tone includes a voltage modulation system and a pulse width modulation system.

Embodiments of the present invention will be hereinafter described. The present invention is not limited to these embodiments.

First Embodiment

This embodiment is an example in which an electron source substrate formed by connecting a large number of surface conduction electron-emitting devices in matrix wiring as shown in FIG. 1 was manufactured. In FIG. 1, reference numeral 21 denotes a substrate; 2 and 3 denotes device electrodes; 4 denotes conductive films (device films); 5 denotes electron-emitting portions; 24 denotes Y-direction wirings (wirings for a modulation signal); 25 denotes interlayer insulating layers; and 26 denotes X-direction wirings (wirings for a scan signal).

A method of manufacturing the electron source substrate of this embodiment will be hereinafter described with reference to FIGS. 2 to 7A through 7C.

(Forming Device Electrodes)

Figure 2:
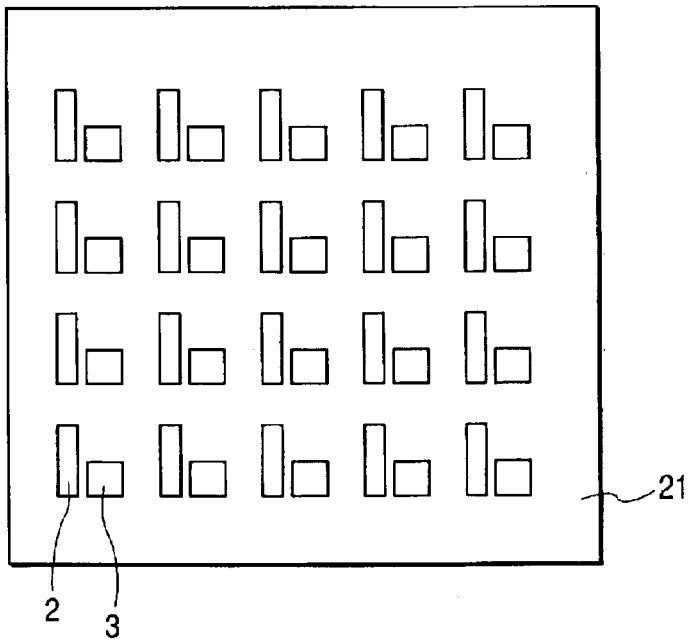
FIG. 2 is a view for explaining a manufacturing process of the electron source substrate of FIG. 1.
Figure 3:
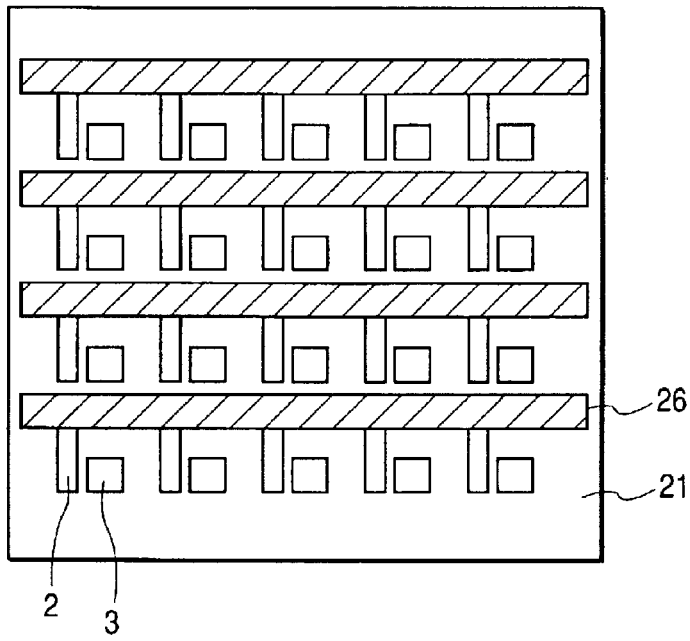
FIG. 3 is a view for explaining a manufacturing process of the electron source substrate of FIG. 1.
Figure 4:
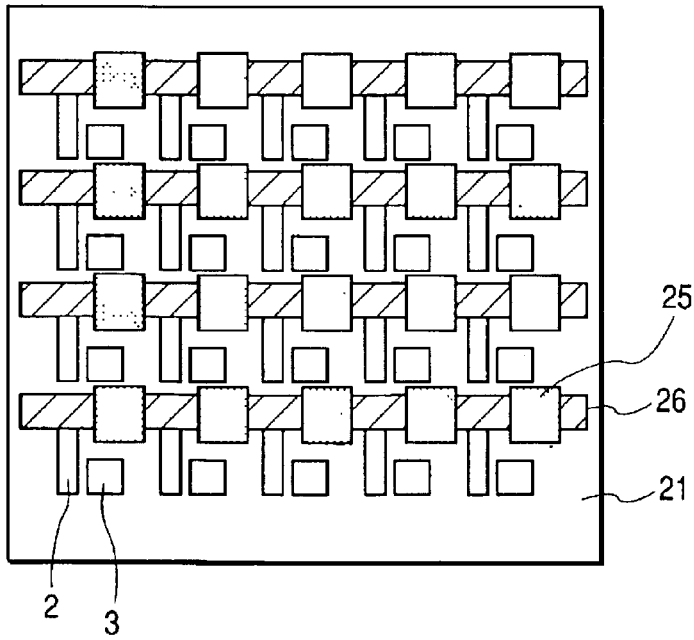
FIG. 4 is a view for explaining a manufacturing process of the electron source substrate of FIG. 1.

After forming a film of titanium Ti (5 nm thick) first as an underlying layer and a film of platinum Pt (40 nm thick) on the titanium layer by sputtering, photoresist was applied over the films, and the films were patterned by a series of photolithography method of exposure, development and etching to form the device electrodes 2 and 3 on the glass substrate 21 (see FIG. 2). Note that in this embodiment, an interval L between the device electrodes was assumed to be 10 μm and a length W of the device electrodes opposed to each other was assumed to be 100 μm.

(Forming X-direction Wirings)

A wiring material of the X-direction wirings 26 and the Y-direction wirings 24 is desired to be low resistance such that a substantially equal voltage is supplied to a large number of surface conduction electron-emitting devices. Materials, film thickness, wiring widths and the like of the wirings are appropriately set.

The X-direction wirings (wirings for a scan signal) 26 were formed by screen printing silver (Ag) paste ink and thereafter drying it, and then baking it at a temperature of around 420° C. (see FIG. 3). Such X-direction wirings 26 are connected to one of each device electrode pair (in this embodiment, the device electrode 2) arranged in the X-direction and act as a scanning electrode after turning into a panel. A thickness and a line width of the X-direction wirings 26 are approximately 15 μm and approximately 100 μm, respectively. Note that, although not shown, pull-out wirings to an external driving circuit were formed in the same method as this.

(Forming Interlayer Insulating Layers)

In order to insulate the X and Y-direction wirings, the interlayer insulating layers 25 are formed. The interlayer insulating layers 25 was formed in an island shaped pattern such that the interlayer insulating layers 25 covered crossing portions of the Y-direction wirings (wirings for a modulation signal) discussed later and the X-direction wirings (wirings for a scan signal) 26 already formed and such that electric connection between the Y-direction wirings and the other device electrode (in this embodiment, the device electrode 3) was possible (see FIG. 4).

More specifically, after screen printed over an entire surface of a substrate, the photoglass paste was exposed using a photomask having a predetermined pattern and subsequently developed and baked. In this embodiment, a process of printing—exposure—development—baking was repeated four times to laminate the interlayer insulating layer 25. Note that the baking was performed at a temperature around 480° C. A thickness of the interlayer insulating layer 25 is approximately 30 μm as a whole and a width of the same is 150 μm.

(Forming Y-direction Wirings)

Figure 5:
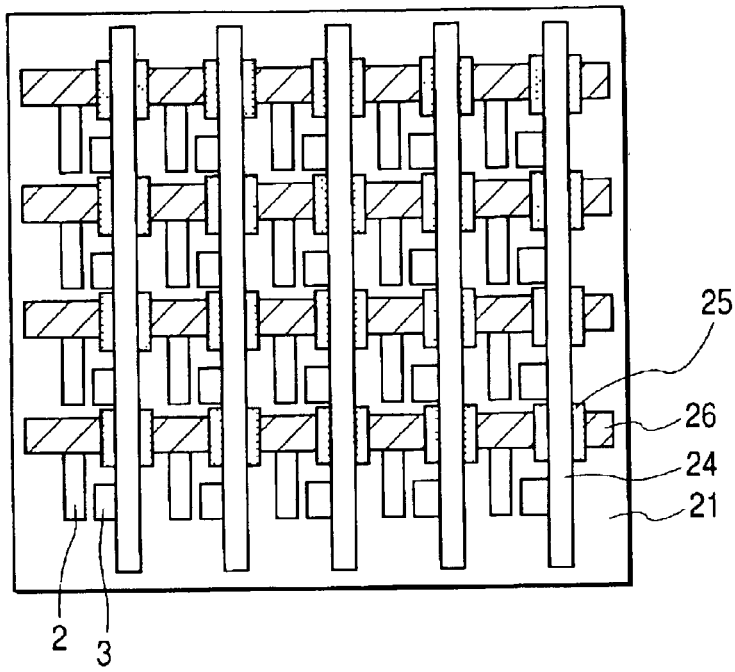
FIG. 5 is a view for explaining a manufacturing process of the electron source substrate of FIG. 1.

The Y-direction wirings (wirings for a modulation signal) 24 as common wirings were formed in a line shaped pattern such that the Y-direction wirings come into contact with the other of each device electrode pair arranged in the Y direction (in this embodiment, the device electrode 3) and couple them (see FIG. 5). Silver (Ag) photo paste ink was used as a material. After having been screen printed, the photo paste ink was dried, and then after having been exposed using a photomask of a predetermined pattern, the photo paste ink was developed.

Thereafter, the photo paste ink was baked at a temperature of around 480° C. to form wirings. Note that a thickness and a line width of the Y-direction wirings 24 are approximately 10 μm and approximately 50 μm, respectively. In end portions of the Y-direction wirings, a line width was made larger in order to use them as wiring extraction electrodes.

In this way, a substrate having the X and Y matrix wiring was formed.

(Forming Conductive Films)

Next, after sufficiently cleaning the above-mentioned substrate, its surface was treated with solution containing a water repellent to make the surface hydrophobic. This is for the purpose of applying aqueous solution for forming a conductive film, which is applied thereafter, with a reasonable extent over the device electrodes.

Thereafter, the conductive film 4 was formed between the device electrodes 2 and 3. This process will be described with reference to a schematic view of FIGS. 7A through 7C. Further, in order to compensate for planar dispersion of respective device electrodes on the substrate 21, positional dislocation of a pattern was observed in several parts on the substrate. An amount of dislocation of points among the observation points was linearly approximated to be positionally complemented, and a conductive film forming material was applied on the substrate. Consequently, positional dislocation of all pixels was eliminated to apply the conductive film forming material to a corresponding position accurately.

Figure 7A:
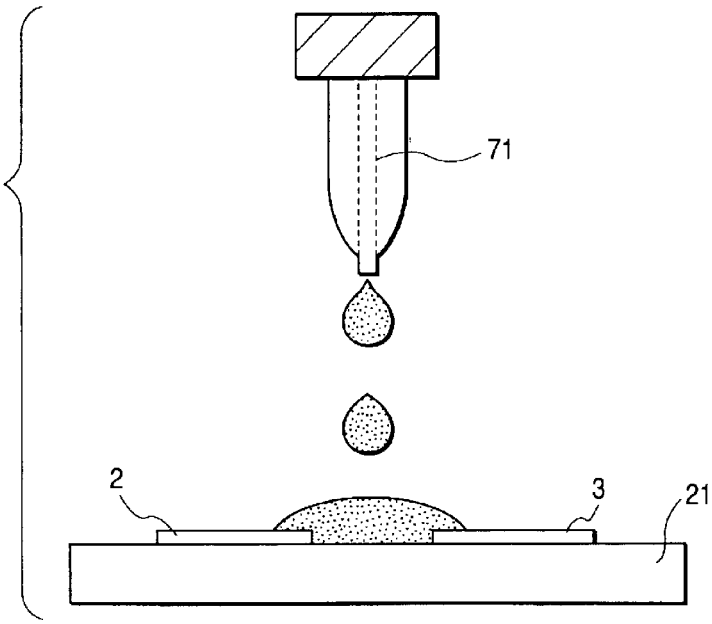
FIGS. 7A, 7B and 7C are views for explaining a manufacturing process of the electron source substrate of FIG. 1.

In this embodiment, for the purpose of obtaining a palladium film as the conductive film 4, first, a palladium-proline complex of 0.15 weight % was solved in aqueous solution consisting of water 85 and isopropyl alcohol (IPA) 15 to obtain solution containing organic palladium. A little additive was added as well. A drop of this solution was adjusted to have a dot diameter of 60 μm and was given to the part between the device electrodes using an ink jet injection device, which used piezo-devices, as drop giving means 71 (FIG. 7A).

Figure 7B:
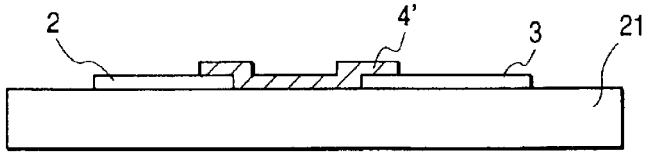

Thereafter, this substrate was subjected to heating and baking processing for ten minutes at 350° C. in the air, and a conductive film 4' consisting of palladium oxide (PdO) was formed (FIG. 7B). A film with a diameter of dots of approximately 60 μm and a maximum thickness of 10 nm was obtained.

(Forming Process)

Figure 7C:
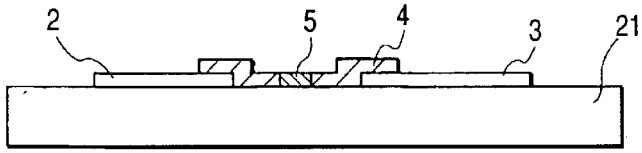

Next, in a process called forming, energization operation is applied to the above-mentioned conductive film 4' to cause a crack in its inside to form the electron-emitting portion 5 (FIG. 7C).

As a specific method, a hood shaped cover is placed to cover the entire substrate 21 leaving the pull-out wiring portion around the substrate 21 to create a vacuum space inside between the hood and the substrate 21. A voltage is applied between both the direction wirings 24 and 26 through a terminal portion of the pull-out wiring from an external power supply to apply an electric current between the device electrodes 2 and 3. Consequently, the conductive film 4' is destroyed, deformed or altered locally, whereby the electron-emitting portion 5 in a state of electrically high resistance is formed.

At this point, if energized and heated under a vacuum atmosphere containing a little hydrogen gas, reduction is facilitated by hydrogen and the conductive film 4' consisting of palladium oxide PdO changes to the conductive film 4 consisting of palladium Pd.

During this change, a crack (gap) occurs in a part of the conductive film 4 due to reduction and shrinkage of the film. A position where the crack occurs and a shape of the crack is significantly affected by uniformity of the original film. In order to control dispersion of characteristics of a large number of devices, it is most desirable that the crack occurs in the central part of the conductive film 4 and is linear as much as possible.

Further, although electrons are also emitted from the vicinity of a crack formed by this forming under a predetermined voltage, an electron emission efficiency is still very low under the current conditions.

In addition, a resistance value Rs of the obtained conductive film 4 is a value from 102 Ω to 107 Ω.

In this embodiment, a pulse waveform as shown in FIG. 8B was used in the forming operation, and T1 and T2 were assumed to be 0.1 msec and 50 msec, respectively. The applied voltage was increased by about 0.1 V step for every five seconds starting from 0.1 V. In the energization forming operation, an electric current flowing to the devices when a pulse voltage is being applied was measured to find a resistance value, and energization forming was finished when the resistance value indicates a resistance, for example, 1000 times or more as large as a resistance before the forming operation.

(Activation Operation)

As in the aforementioned forming, an activation operation is performed by placing a hood shaped cover to create a vacuum space inside between the hood and the substrate 21 and repeatedly applying a pulse voltage between the device electrodes 2 and 3 through both the direction wirings 24 and 26 from the outside. Then, a gas containing carbon atoms is introduced, and carbon or a carbon compound derived from the gas is deposited as a carbon film in the vicinity of the crack.

In this embodiment, tolunitrile was used as a carbon source and was introduced into the vacuum space through a slow leak valve to maintain a pressure of $1.3\times10^{-4}$ Pa.

FIGS. 11A and 11B show a preferred example of voltage application used in an activation process. A maximum voltage value to be applied is appropriately selected in a range of 10 V to 20 V.

In FIG. 11A, reference symbol T1 denotes positive and negative pulse widths of a voltage waveform and T2 denotes a pulse interval. Positive and negative voltage values are set such that their absolute values are the same. In addition, in FIG. 11B, reference symbols T1 and T1' denote positive and negative pulse widths of a voltage wave form, respectively, and T2 denotes a pulse width. T1 is set larger than T1', and positive and negative voltage values are set such that their absolute values are the same.

In this case, a voltage given to the device electrode 3 is assumed to be positive, and the device current If is positive in a direction in which the device current If flows from the device electrode 3 to the device electrode 2. Energization was stopped when the emission current Ie nearly reached saturation after approximately sixty minutes, the slow leak valve was closed and the activation operation was finished.

With the above-mentioned process, an electron source substrate formed by connecting a large number of electron-emitting devices in matrix wiring on the substrate could be manufactured.

(Evaluation of Characteristics of an Electron Source Substrate)

Electron emission characteristics of the electron source substrate that had the above-mentioned device structure and was manufactured by the above-mentioned method was measured using the device shown in FIG. 9. As a result, when the emission current Ie at a voltage 12 V applied to the part between the device electrodes was measured, an average current of 0.6 $\mu$A was obtained. As an electron emission efficiency, an average of 0.15% was obtained. In addition, uniformity among the devices was also good, and dispersion of Ie among the devices was favorable at 5%.

Next, an image display device (display panel) as shown in FIG. 12 was manufactured using the electron source substrate of the passive matrix arrangement manufactured as described above. Note that FIG. 12 is partially cut away in order to show the inside of the image display device.

In this embodiment, the electron source substrate 21, the supporting frame 86 and the face plate 82 were adhered by frit glass and were sealed by baking for 30 minutes at 480° C. to obtain the envelope 90.

Further, this series of processes were all performed in a vacuum chamber, whereby it became possible to make the inside of the envelope 90 vacuum from the beginning, and at the same time to simplify the processes.

In this way, the display panel as shown in FIG. 12 was manufactured, and a drive circuit consisting of a scanning circuit, a control circuit, a modulation circuit, a direct current voltage source and the like was connected to the display panel to manufacture an image display device of a panel shape.

In the image display device manufactured as described above, electrons were emitted by applying a voltage to each electron-emitting device through an X-direction terminal and a Y-direction terminal, a high voltage was applied to the metal back 85 functioning as an anode electrode through a high voltage terminal Hv, a generated electron beam was accelerated and caused to collide against the fluorescent film 84, whereby an image was displayed.

The image display device in this embodiment had high electric reliability of the X and Y-direction wirings, and therefore had a satisfactory image quality.

Second Embodiment

Figure 6:
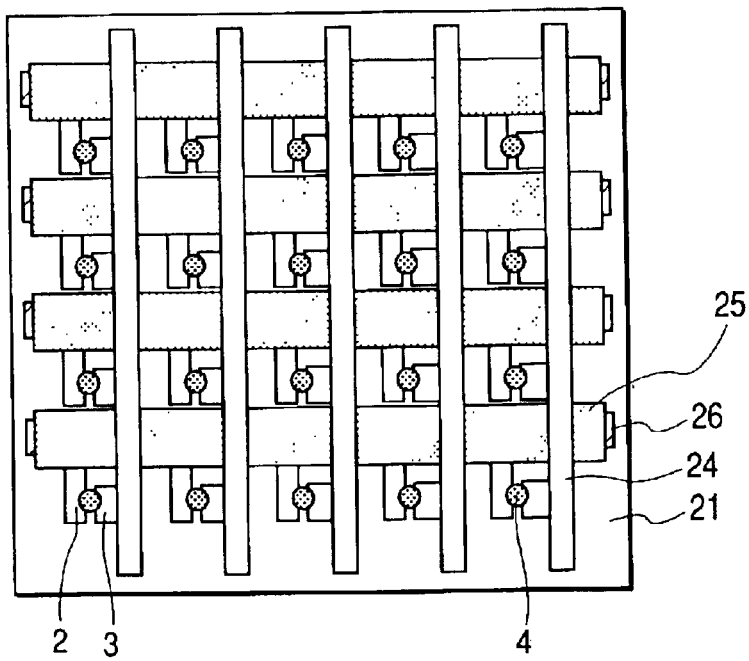
FIG. 6 is a plan view schematically showing another example of the structure of the electron source substrate in accordance with the present invention.

An image display device was formed by the same processes as those in the first embodiment except that a pattern of an interlayer insulating layer had a line shape. FIG. 6 shows this matrix pattern.

The image display device in this embodiment had high electric reliability of the X and Y-direction wirings, and therefore had a satisfactory image quality.

As described above, according to the present invention, it is possible to provide a method of manufacturing a member pattern that is suitable for forming a high precision member pattern such as wiring and can realize cost reduction.

In addition, the present invention can provide a method of manufacturing an electron source that can realize cost reduction without damaging electric reliability of matrix wiring that supplies driving power to a plurality of electron-emitting members.

What is claimed is:

1. A method of manufacturing a member pattern having on a substrate, a patterned first member and a plurality of second members that are patterned over both of said first member and said substrate, said method comprising:

forming said first member by a printing method without involving a usage of a photosensitive material and without subjecting the photosensitive material to an exposure and development; and forming on said first member said second members by a process involving the usage of the photosensitive material and subjecting the photosensitive material to the exposure and the development.

2. A method of manufacturing a member pattern according to claim 1, wherein said first and second members are conductive members and an insulating member is arranged between said first member and said second members.

3. A method of manufacturing an electron source having on a substrate, a plurality of first wirings, a plurality of second wirings that are crossed over said plurality of first wirings via an insulating member, and a plurality of electron-emitting members that are wired in a matrix by said plurality of first and second wirings, said method comprising:

forming said plurality of first wirings by a printing method without involving a usage of a photosensitive material and without subjecting the photosensitive material to an exposure and development; and forming on said first wirings through an insulating member said plurality of second wirings by a process involving the usage of the photosensitive material and subjecting the photosensitive material to the exposure and development using a photosensitive material.

4. A method of manufacturing an electron source according to claim 3, wherein said plurality of first wirings are wirings to which a scan signal is applied and said plurality of second wirings are wirings to which a modulation signal is applied.

5. A method of manufacturing an image display device provided with an electron source and a member that is arranged so as to oppose said electron source and emits light by irradiation of electrons from said electron source, wherein said electron source is manufactured by the method as set forth in claim 3.

6. A method of manufacturing a member pattern having, on a substrate, a patterned first member and a plurality of second members that are patterned over both of the first member and the substrate, the method comprising steps of:

applying on the substrate a non-photosensitive material containing an ingredient of the first member to form a precursor pattern of the first member;

baking the precursor pattern;

applying over both of the first member and the substrate, a photosensitive material containing an ingredient of the second member, and subjecting the photosensitive material to an exposure and a development to form a precursor pattern of the second member; and baking the precursor pattern of the second member.

7. The method according to claim 6, wherein the applying of the non-photosensitive material containing the ingredient of the first member is performed according to a printing method.

8. The method according to claim 7, wherein the printing method is a screen printing method.

9. A method of manufacturing an electron source having, on a substrate, a plurality of first wirings, a plurality of second wirings intersecting the first wirings over the first wirings through an insulating layer, and a plurality of electron-emitting members wired in a matrix through the first and second wirings, the method comprising the steps of:

applying, to the substrate, a non-photosensitive material containing an ingredient of the first wirings to form a precursor pattern of the first wirings;

baking the precursor pattern of the first wirings;

applying, to the insulating layer over the first wirings, a photosensitive material containing an ingredient of the second wirings, and subjecting the photosensitive material to an exposure and a development to form a precursor pattern of the second wirings; and baking the precursor pattern of the second wirings.

10. The method according to claim 9, wherein the applying of the non-photosensitive material containing the ingredient of the first wirings is performed according to a printing method.

11. The method according to claim 10, wherein the printing method is a screen printing method.

12. The method according to claim 9, wherein at least one of the first wirings forms a line to which a scanning signal is to be supplied, and at least one of the second wirings forms a line to which a modulation signal is to be applied.

13. A method of manufacturing an image display apparatus having an electron source and a member emitting light in response to being irradiated with an electron emitted from the electron source, wherein the electron source is manufactured according to the method of claim 9.

* * * * *